US005111583A

United States Patent [19]

Martinez Alcala

[11] Patent Number: 5,111,583

[45] Date of Patent: May 12, 1992

[54] BLADED IMPLEMENT

[76] Inventor: Jose M. Martinez Alcala, s/n, Energia Street, 08004 Barcelona, Spain

[21] Appl. No.: 729,347

[22] Filed: Jul. 12, 1991

[30] Foreign Application Priority Data

Oct. 17, 1990 [ES] Spain ..... 9002614

[51] Int. Cl.[5] ..... B26B 9/00

[52] U.S. Cl. ..... 30/346; 30/513; 30/348; 30/356

[58] Field of Search ..... 30/346, 356, 348, 513

[56] References Cited

U.S. PATENT DOCUMENTS 1,094,939 4/1914 Smith ..... 30/513
1,116,881 11/1914 Giampietro ..... 30/356
2,519,904 8/1950 Hendricksen et al. ..... 30/513
2,606,585 8/1952 Collura ..... 30/513

*Primary Examiner*—Douglas D. Watts
*Assistant Examiner*—Hwei-Siu Payer
*Attorney, Agent, or Firm*—Fleit, Jacobson, Cohn, Price, Holman & Stern

[57] ABSTRACT

A bladed implement such as a knife, has a flexible blade extending from a handle. The blade can be rigidified for use by a series of slides which run along a slot in the blade and which can be forced into and held in end to end contact by an operating mechanism in the handle. The endmost slide engages a stop at the distal end of the slot. When the operating mechanism is released, the slides are free to separate and the flexibility of the blade is restored.

10 Claims, 2 Drawing Sheets

BLADED IMPLEMENT

BACKGROUND OF THE INVENTION

This invention relates to a bladed implement such as a knife, more particularly an implement comprising a handle and a blade, provided on at least a part of its length with a cutting edge and, preferably but not necessarily, a sharp tip, and which may have a number of sizes and proportions, for the purposes of being used as a defense or attack weapon (knife, rapier, machete, or the like) or as a tool, for example, for performing agricultural tasks.

A feature of the implement is that it has a blade endowed with a high degree of flexibility, capable of being adapted to small radii of curvature, which, through a simple, ingenious and safe mechanism and by means of a simple and practically instantaneous maneuver, can be endowed with the same degree of rigidity as a normal, conventional-type blade, allowing for cutting and puncturing applications of such a blade. The aforesaid flexibility means that the implement in its entirety may be transported, with complete comfort and without any danger, for example, adapted to the user's waist and, more particularly, accommodated in a sheath provided on a special belt, on which additional compartments may be provided for accommodating a plurality of defense and/or survival means.

It is well known that, from earliest antiquity, man has aspired to construct knives or similar implements whose presence would be difficult or impossible to detect and which would cause their bearer the least possible nuisance, discomfort and danger. In this respect, however, practically speaking, progress has stopped with conventional jackknives or pocket knives in which the blade can remain housed in a handle, either by means of a turning motion, or by means of axial sliding. In these implements, the length of the blade clearly cannot exceed that of the handle, nor can the assembly, with the blade folded in, exceed certain dimensions, so that it is impractical to make a tool or implement of this kind that can perform the functions of a machete or similar device. To obviate these clear limitations, various systems of telescoping blades have been proposed, but these attempted solutions have not attained practical effectiveness, both because of the very notable price increase involved in manufacturing such blades and, very particularly, because of their limited reliability.

SUMMARY OF THE INVENTION

An object of the invention is to provide a bladed implement which, through flexibility of the blade and through the high degree of rigidity that the blade attains in the armed position, makes it possible to overcome the aforesaid disadvantages, making it possible to provide the blade with dimensions equivalent to those currently used in machetes, rapiers or similar implements, or even a sword or similar weapon, and making it possible to utilize the assembly, once it is armed, under the same conditions of safety and efficiency as if it had a conventional rigid blade.

For the above purposes, essentially, according to the invention, the blade of the implement is made of a highly flexible quality of steel, similar, for example, to that normally used in making band saws, and it is provided essentially with a longitudinal guide which extends from the hilt to the proximity of the tip or free end. Along this guide can slide freely a series of slides of limited length, preferably equally alike, which in the inoperative position for storing and transporting the weapon or implement, are separated from one another, in practice not substantially reducing the conditions of flexibility of the blade, but which, through a mechanism housed in a hilt or handle with which the blade is associated, can be caused to be applied with considerable pressure against one another with the end most slide being applied against a stop provided at the distal end of the guide. In this position, the successive slides, strongly applied by their bases against one another, and possibly fitted into one another thereby, act as a rigid body and thereby also cause the entire assembly of the blade to act as such.

The guide in which the slides are braced can have a number of forms, such as, for example, the form of a longitudinal filament or two opposing longitudinal filaments which are solid with the blade and provided with any appropriate cross-section (L, T, omega, or the like), all of these possibilities to be considered within the context of the invention. In one form of the invention, the guide simply consists of a central longitudinal slot provided on the blade which extends to the proximity of the tip or free end thereof, and into which the slides fit through corresponding opposing channels.

Also within the context of the invention, one may modify within relatively broad limits the structure of the mechanism housed at least to a large extent in the handle or hilt of the implement, by means of which the slides are either released or pressed against the end stop of the guide. In one form of the invention, the mechanism comprises a rod inserted into the guide in the same way as the slides, the rod being at least partially housed in the handle and which may be projected forwardly by an elastic force, forcefully applying the slides against the end stop of the guide.

Also within the context of the invention, one may broadly modify the elastic mechanism which acts on the rod, it being possible for this mechanism to consist of one or more springs which act directly on said rod. In one form of the invention, the mechanism has the form of a linkage consisting of two articulated arms which can move from a folded position in which the springs will remain relaxed and the slides released, to an open position, slightly exceeding the position of maximum length, in which the springs will remain compressed, transmitting their expansive force to the slides through the rod and the linkage.

DESCRIPTION OF PREFERRED EMBODIMENT

Figure 1:
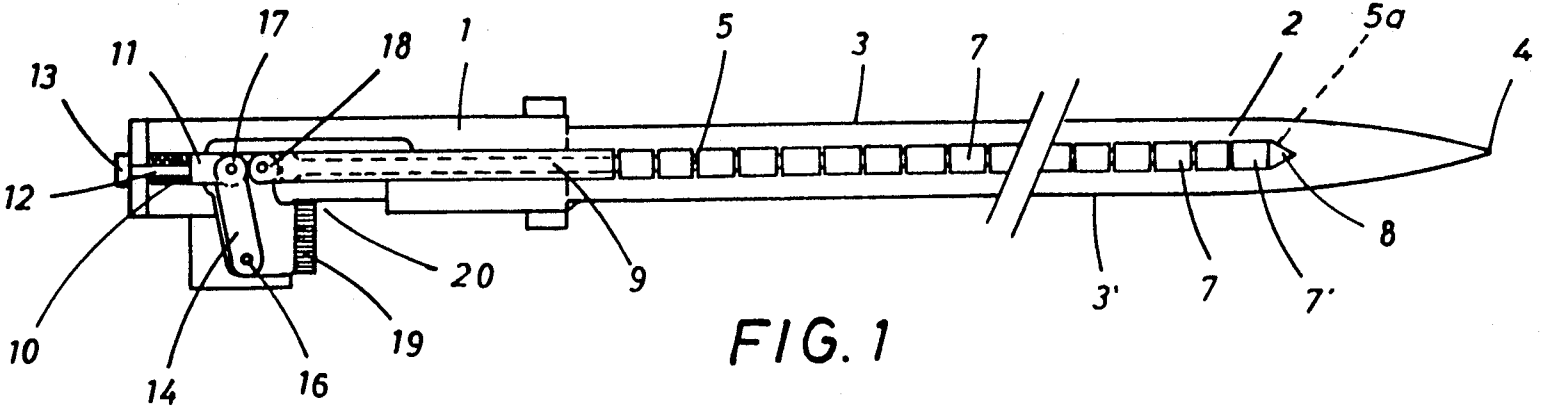
FIGS. 1 and 2 are longitudinal cross-sectional views of a weapon assembly, showing it in an inoperative position for storage and transport, and in a use position, respectively.

The illustrated weapon type bladed implement comprises a handle or hilt 1 which may have any form and may be made of any material or combination of materials deemed appropriate, and a blade 2, whose dimensions and proportions will vary according to the specific function for which the implement is intended and which, in accordance with such function, may exhibit a single cutting edge or two cutting edges 3-3' and may or may not end in a sharp tip 4. The blade is made of a material, such as certain special types of steel already existing in the market, which exhibits a high degree of flexibility, such that it can be adapted to curvatures of a relatively small radius.

The blade 2 has a longitudinal slot 5, preferably a central slot, of limited width (for example, approximately 2 mm) which extends from the hilt to the proximity of the tip 4. Engaged to slide in and along said slot across corresponding opposing channels 6-6', and able to slide freely, is a series of slides 7, preferably alike, made of a lightweight material which exhibits a high degree of resistance to deformation, particularly to compressive stress. Slide 7', which occupies the end position on the assembly, can advantageously exhibit a conical extension 8 which reinforces the rigidity of the tip 4.

In slot 5 also fits, by identical means, a rigid rod 9 which remains partially housed in the handle 1 and which can slide axially, guided by the handle itself and by said slot.

Inside the handle 1 is provided a cavity coaxial with the rod 9, in which is housed a strong spring 10 which can consist of a helicoidal spring or a series of elastic disks or can adopt any other known form. The spring acts constantly against a piston 11, causing it to adopt a limit position determined, for example, by a rod 12 provided with an end stop 13. Between the piston and the rod 9 is provided a linkage, formed by two arms 14, 15 mutually articulated through a hinge 16, and articulated to the piston 11 and the rod 9 through hinges 17, 18. On arm 15 of the linkage carries a control mechanism 19, for example, in the form of a trigger or push-button, which constantly protrudes outward, across a suitable opening 20 provided in the hilt, remaining in a position to be actuated.

Figure 2:
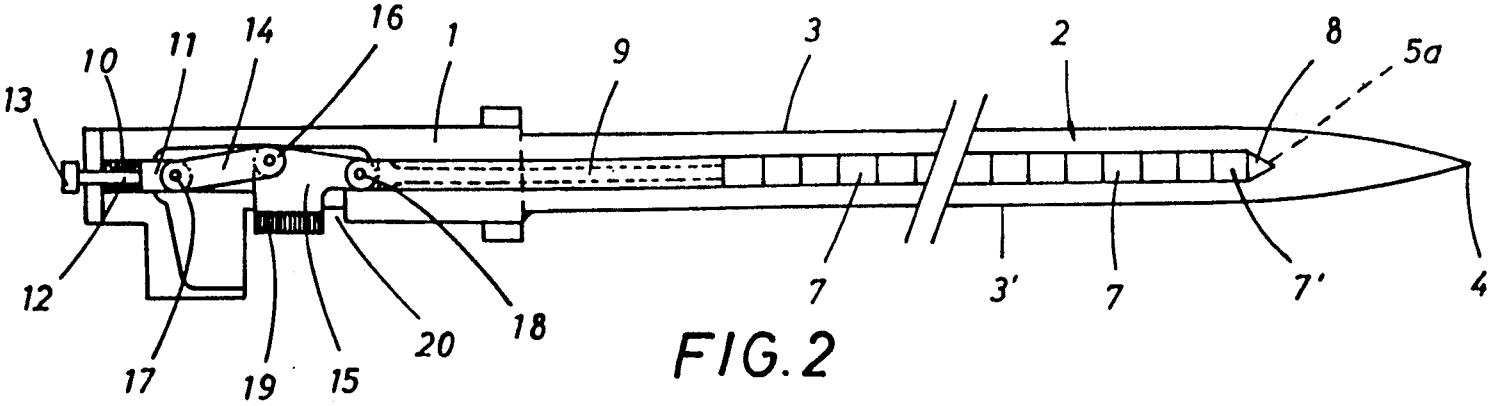
Figure 3:
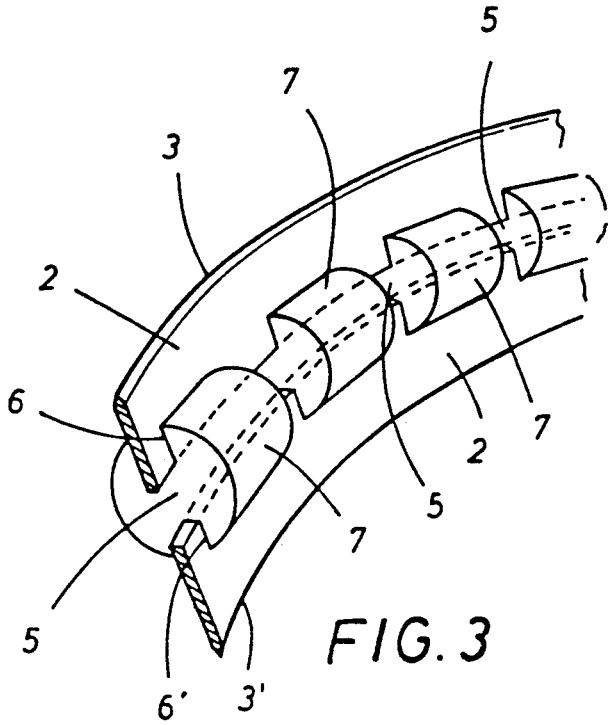
FIGS. 3 and 4 ar enlarged perspective views showing a part of a blade of the assembly in one and the other of said positions, respectively.
Figure 4:
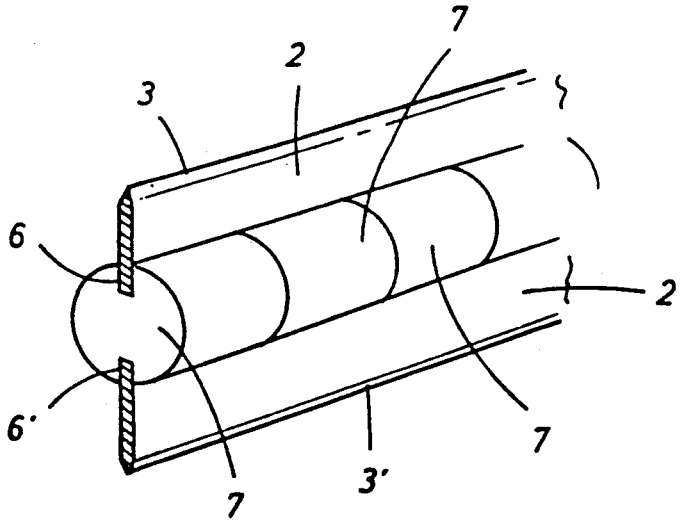

The assembly is designed so that in one position (shown in FIG. 1), the linkage is folded, the spring 10 is relaxed to the limit defined by the stop 13, and the rod 9 adopts its retracted position toward the inside of the hilt, the slides 7 being sufficiently separated from on another to allow the blade assembly to flex freely and adapt to any curvature, particularly and in the manner in principle most suitable for operating the invention, to the curvature of a body sheath provided around a belt that will form part of a user's apparel. From this position, and once the weapon is removed from the sheath, it will suffice to exert pressure on the control mechanism 19 to effect extension of the linkage 14, 15, which will be immobilized with complete safety as it adopts the limit position shown in FIG. 2, that is, a position in which it will have slightly exceeded that of maximum extension (with the two arms aligned) corresponding to the maximum spring tension. (Extension of the linkage may, for example, be effected by rearward pressure on mechanism 19, causing joint 16 to move along a ramp surface in the handle.) In the extended position, the full expansive force of the spring, which can be quite considerable, will press the successive slides against one another and finally against the distal end of the slot 5 which form a stop 5a for the slides. In this position of the slides, which is shown in FIG. 4, the assembly formed thereby as they are applied forcefully against one another will act as a rigid rectilinear body, and consequently, the blade with which said slides are solid will exhibit the same conditions of rigidity, permitting all the applications of a conventional cutting and puncturing blade. In order for the blade to recover its features of flexibility and be inserted again into the sheath, it will suffice to actuate mechanism 19 again, driving the linkage to the opposite limit position, which will be automatically recovered because of the expansive action of the spring, once the position of maximum extension is exceeded.

It is important to point out that, when the blade is in the use position, that is, when the slides 7, applied against one another, provide its rigidity, any flexing force exerted on said blade can result in very significant compressive stress on the spring 10, stress that can even exceed the maximum elasticity of said spring, which may even disable it. In order to obviate this danger, it will suffice to arrange any system of stops which limits in a sense the movement possibilities of the aforesaid movable components. Thus, for example, in a particularly simple and efficient form of implementation, hinge 17 can be slightly extended and its ends can fit into extended housings of very limited length provided-in the handle. This simple arrangement, besides protecting the spring (and more precisely, a series of stacked elastic plates or disks when such make up the spring) against permanent deformations, also ensures the rigidity of the blade, allowing it, once armed, really minimal elastic flexing movements.

It is important to note that, although the invention has been particularly described for purposes of its application to knives and tools or similar implements, the rigidification system which constitutes the invention may also be advantageously applied to other implements or components, such as, for example, radiotelegraph antennae, metallic measuring tapes, and the like. These broad application possibilities should also be considered included in the indicated scope of application.

I claim:

1. A bladed implement which comprises a handle and a flexible blade extending from the handle, a longitudinal guide which extends along the blade from the handle to a distal end adjacent a free end of the blade, a series of slides mounted end to end along said guide for sliding movement along the guide, the slides having an inoperative position in which they are separated from one another permitting flexing movements of the blade, and an operating mechanism at least partially housed in the handle for causing the slides to be releasably applied with pressure against one another end to end with an endmost one of the slides being applied against a stop provided at the distal end of the guide, thereby forming the blade into a substantially rigid body which resists said flexing movements.

2. An implement according to claim 1, wherein the guide comprises a longitudinal slot in the blade.

3. An implement according to claim 2, wherein the slides comprise a series of small solid equally alike components provided with opposing channels through which they are engaged to slide along opposed edges of the blade defining the slot.

4. An implement according to claim 1, wherein the operating mechanism includes a spring inside the handle, which in an operative position of the operating mechanism acts by compression on said slides, compressing them against the stop, and in the inoperative position remains disconnected from said slides in a limit position of maximum expansion leaving the slides free to slide along the guide and allowing the flexing movements of the blade.

5. An implement as claimed in claim 1, wherein the blade has at least one cutting edge.

6. An implement according to claim 1, wherein the operating mechanism includes a slide rod extending from the handle partly along the guide to engage a proximal one of the slides and an articulated foldable and unfoldable elbow-type linkage contained within the handle for projecting and retracting the slide rod.

7. An implement according to claim 6, wherein the linkage comprises a first link pivotally connected to the slide rod and a second link pivotally connected to the first link.

8. An implement as claimed in claim 7, wherein the second link is pivotally connected to a piston element in the handle engaged by a spring for applying spring pressure on the slides when the linkage is unfolded so as to project the slide rod from the handle and apply pressure on the slides, and for releasing the spring pressure when the linkage is folded thereby retracting the slide rod into the handle.

9. An implement as claimed in claim 8, wherein the first link includes an actuator for folding and unfolding the linkage.

10. An implement as claimed in claim 8, wherein the operating mechanism includes stop means for preventing the piston element applying backward force against the spring when the slide rod is projected from the handle.

* * * * *